US010293986B2

(12) United States Patent
Pitts

(10) Patent No.: US 10,293,986 B2
(45) **Date of Patent: *May 21, 2019**

(54) DISPLAY SYSTEM WITH PACKETS HAVING INTEGRAL CONNECTORS

(71) Applicant: AGS Company Automotive Solutions LLC, Pittsburgh, PA (US)

(72) Inventor: Logan D. Pitts, North Muskegon, MI (US)

(73) Assignee: AGS Company Automotive Solutions LLC, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/104,965

(22) Filed: Aug. 20, 2018

(65) Prior Publication Data

US 2018/0354685 A1 Dec. 13, 2018

Related U.S. Application Data

(63) Continuation of application No. 14/955,531, filed on Dec. 1, 2015, now Pat. No. 10,053,265.

(60) Provisional application No. 62/086,450, filed on Dec. 2, 2014.

(51) Int. Cl.

| | |
|---|---|
| ***B65D 69/00*** | (2006.01) |
| ***B65D 35/24*** | (2006.01) |
| ***B65D 35/02*** | (2006.01) |
| ***B65D 75/30*** | (2006.01) |
| ***B65D 75/56*** | (2006.01) |

(52) U.S. Cl.

CPC ..... *B65D 35/245* (2013.01); *B65D 35/02* (2013.01); *B65D 69/00* (2013.01); *B65D 75/30* (2013.01); *B65D 75/566* (2013.01); *B65D 2575/565* (2013.01)

(58) Field of Classification Search

CPC .... B65D 21/0235; B65D 25/22; B65D 35/02; B65D 35/245; B65D 69/00; B65D 73/0064; B65D 75/32; B65D 75/70; B65D 75/566; B65D 2575/565; B65D 2577/043

USPC ..... 206/223, 461, 463, 464, 466, 548, 549, 206/577, 806, 820; 220/23.4, 23.6; 383/37, 127

See application file for complete search history.

(56) References Cited

U.S. PATENT DOCUMENTS

| | | | | |
|---|---|---|---|---|
| 2,833,401 A | | 5/1958 | Lefebvre | |
| 2,833,402 A | | 5/1958 | Lefebvre | |
| 2,850,160 A | | 9/1958 | Siebel | |
| 2,958,889 A | * | 11/1960 | Greenblatt | A46B 3/005 15/143.1 |
| 4,976,354 A | | 12/1990 | Levy | |
| 5,697,177 A | | 12/1997 | Ludlow et al. | |
| 5,791,470 A | | 8/1998 | Usui | |
| 5,819,939 A | * | 10/1998 | Boyer | B65D 75/322 206/461 |
| 5,927,496 A | * | 7/1999 | Seaton | B65D 21/0235 206/461 |

(Continued)

*Primary Examiner* — Luan K Bui
(74) *Attorney, Agent, or Firm* — Honigman LLP

(57) ABSTRACT

A display system includes a plurality of packets that each include a cavity containing flowable material and a body portion that defines the cavity. The packets each include a header portion and a connector tab, with an aperture established through the header portion. The connector tab of each packet includes a neck portion and a retaining portion, which has a wider cross dimension than the neck portion. The retaining portion of one packet, when received through an aperture of a product or another packet, limits retraction from the aperture to join the packet with the product or other packet.

22 Claims, 7 Drawing Sheets

(56) References Cited

U.S. PATENT DOCUMENTS

| | | | | |
|---|---|---|---|---|
| 6,286,690 | B1 * | 9/2001 | Thalenfeld | A47F 5/0006 211/113 |
| 6,302,269 | B1 * | 10/2001 | Risch | A47L 23/04 15/187 |
| 6,305,329 | B1 | 10/2001 | Levy, Jr. | |
| 6,658,813 | B2 | 12/2003 | Clay | |
| 6,679,029 | B2 | 1/2004 | Clay | |
| 6,695,364 | B2 | 2/2004 | Bierlin | |
| 6,905,075 | B1 | 6/2005 | Rosen | |
| 7,014,041 | B1 | 3/2006 | Rosen et al. | |
| 7,219,459 | B2 | 5/2007 | Valiulis et al. | |
| 7,241,066 | B1 | 7/2007 | Rosen | |
| D573,037 | S | 7/2008 | Murray | |
| D606,882 | S | 12/2009 | Sharp | |
| 7,810,667 | B2 * | 10/2010 | Douglas | B65B 43/123 206/390 |
| D632,565 | S | 2/2011 | Caldwell | |
| D632,567 | S | 2/2011 | Caldwell | |
| D640,565 | S | 6/2011 | Tsuruta | |
| D667,312 | S | 9/2012 | Risgalla | |
| D670,573 | S | 11/2012 | McDermott | |
| 8,376,183 | B1 | 2/2013 | Rosen | |
| D698,663 | S | 2/2014 | Lin | |
| D744,352 | S | 12/2015 | Quarles | |
| D744,853 | S | 12/2015 | Murray | |
| D768,006 | S | 10/2016 | Pitts | |
| 10,053,265 | B2 | 8/2018 | Pitts | |
| 2003/0213707 | A1 | 11/2003 | Clay | |
| 2005/0188652 | A1 | 9/2005 | Davolio et al. | |
| 2006/0169604 | A1 | 8/2006 | Clay | |
| 2009/0205981 | A1 | 8/2009 | Daul | |

* cited by examiner

DISPLAY SYSTEM WITH PACKETS HAVING INTEGRAL CONNECTORS

CROSS REFERENCE TO RELATED APPLICATIONS

The present application is a continuation of U.S. patent application Ser. No. 14/955,531, filed Dec. 1, 2015, now U.S. Pat. No. 10,053,265, which claims priority of U.S. patent application Ser. No. 62/086,450, filed Dec. 2, 2014, which is hereby incorporated herein by reference in its entirety.

FIELD OF THE INVENTION

The present invention relates generally to packets that contain a fluid or flowable material and, more particularly, to single use packets that contain a fluid or flowable material, such as liquids, creams, gels, oils, greases, adhesives or other types of flowable and dispensable materials.

BACKGROUND OF THE INVENTION

Single use packets, such as for containing grease or lubricants or adhesive or the like are known. Typically, such packets are displayed at a store via a hanging rod or post inserting through a circular aperture established at an upper end region of the packet. If other packets or products are related to the single use packet, they are sold as separate items, and may be displayed at a separate shelf or hanging rod in the store.

Such individual packets typically consist of two flexible foil sheets secured or sealed together about their periphery to define a cavity between the sheets. The cavity is filled with the flowable material that is being stored. Such packets find widespread use for storing food condiments, such as ketchup, mustard, mayonnaise, and other liquid or semi-liquid foods. When it is time to access the contents of the packet, the user simply tears off a corner portion of the foil material and squeezes out the contents.

SUMMARY OF THE INVENTION

The present invention provides a packet containing flowable material, such as a single use packet of flowable material. The packet includes a connector tab integrally formed as part of the sealed periphery of the packet. The connector tab is formed to fit (when curled or collapsed) through an aperture of a product or other packet, whereby (when uncurled or expanded) the connector tab retains the packets/products together, while also allowing for relatively easy removal or separation of the packets/products.

According to an aspect of the present invention, a packet comprises a cavity containing flowable material and a sealed perimeter portion that defines the cavity. The sealed perimeter portion comprises a header portion and a connector tab. An aperture is established through the header portion. The connector tab comprises a neck portion and a retaining portion, with the retaining portion having a wider cross dimension than the neck portion. The retaining portion, when inserted through an aperture of one of (i) a product and (ii) another packet, limits retraction from the aperture to join the packet with the one of (i) a product and (ii) another packet.

The packet may comprise two foil sheets that are sealed together about the perimeter portion and are not sealed together at the cavity. The retaining portion may comprise any suitable shape, such as a generally rectangular shape or a generally triangular shape (with a wider part of the triangular shape being at said neck portion and with the retaining portion narrowing away from the neck portion).

According to another aspect of the present invention, a display system comprises a plurality of packets each having a cavity containing flowable material and a sealed perimeter portion that defines the cavity, with the sealed perimeter portion comprising a header portion and a connector tab, and with an aperture is established through the header portion. The connector tab includes a neck portion and a retaining portion, and the retaining portion has a wider cross dimension than the neck portion and the retaining portion has a wider cross dimension than the aperture. The retaining portion of a first packet is collapsed or curled and is inserted through an aperture of a second packet, whereby the retaining portion, when expanded to its initial state, limits retraction from the aperture of the second packet to join the first and second packets together.

Optionally, the first and second packets may contain the same flowable material. Optionally, the first and second packets may contain different flowable materials. Optionally, the first and second packets may be part of a strip of multiple packets.

These and other objects, advantages, purposes and features of the present invention will become more apparent upon review of the following specification in conjunction with the drawings.

DESCRIPTION OF THE PREFERRED EMBODIMENTS

Figure 1:
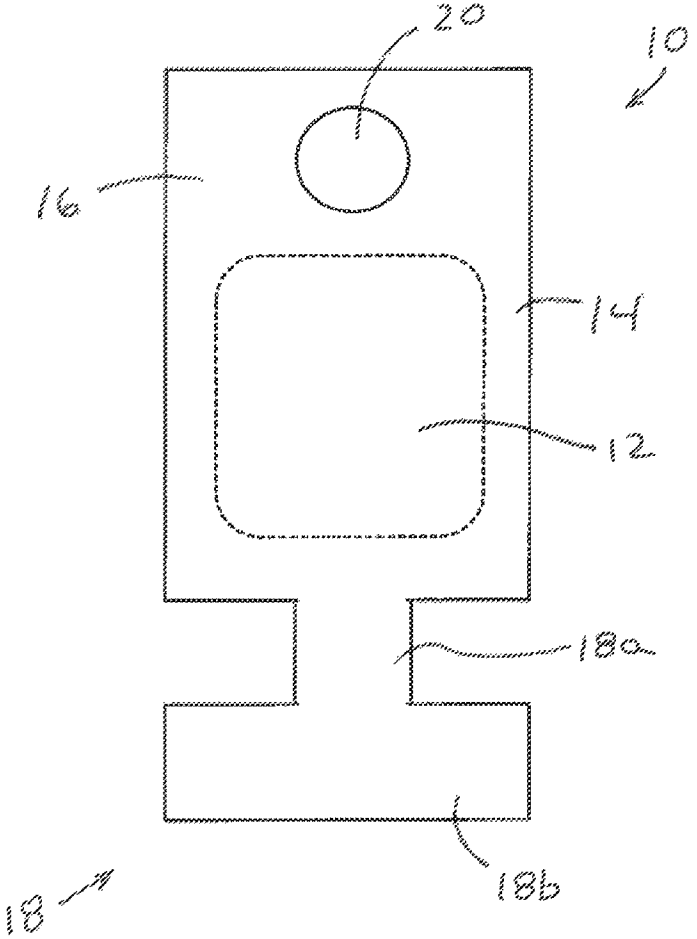
FIG. 1 is a plan view of a single use packet of flowable material in accordance with the present invention.

Referring now to the drawings and the illustrative embodiments depicted therein, a flowable material container or single use packet 10 includes and defines a material holding cavity 12, such as for holding or containing a small amount of grease or adhesive or other flowable material (FIG. 1). The single use packet 10 has a sealed perimeter region 14 that seals about the periphery of the cavity 12 and includes a header portion 16 and a connector portion 18, as discussed below. The connector portion 18 is configured for connection or attachment to a product (that may be related to or associated with the flowable material contained in the cavity 12) or to another packet (such as via an aperture at a header portion of another packet), as also discussed below.

The single use packet 10 comprises a pair of sheets or sheet portions of printed flat stock or material, such as foil sheets or plastic or polymeric sheets or the like. The sheets may comprise separate sheets sealed or joined or bonded together, or may comprise a single sheet folded over upon itself to form two adjacent sheets or sheet portions, without affecting the scope of the present invention. The sheets may be selectively sealed or bonded or pressed or otherwise joined together to define the cavity 12 for containing the flowable material. For example, the sheets may be heat sealed together (such as by joining or sealing the sheets together by heating the sheets while they are mated or pressed together) to define the cavity. The cavity is defined by an area or region of the sheets that is not sealed or joined or bonded together, such that the desired flowable material may be injected or provided or filled into the cavity, such as before or as the sheets are sealed together, whereby the cavity contains a small amount of flowable material therein. The cavity is sized or designed to hold a small amount of material, such that little material will be wasted after a single use and after the packet is discarded or thrown away. The packet may utilize aspects of the packets described in U.S. Pat. Nos. 6,905,075; 7,014,041 and/or 7,241,066, which are hereby incorporated herein by reference in their entireties.

The cavity of each dispenser may be formed generally in the shape of a small typical adhesive dispenser, and may have a narrowed tip portion or dispensing tip or the like for dispensing adhesive from the dispenser. Optionally, the container may include a perforated or scored or otherwise marked or weakened line along an end of the dispensing tip or region (or a notched edge at the sealed perimeter region adjacent to the dispensing region) to facilitate tearing or cutting or ripping the packet to open the single use dispenser or packet for dispensing the material from the cavity.

The sheets may comprise any suitable material, such as foil or plastic or polymeric material or the like, for containing and hermetically sealing the adhesive within the separate cavities of the container. The foil sheets or the like may be sealed or joined or bonded or crimped or the like in the areas about the periphery of the cavity to define the cavity or pocket for hermetically containing and sealing the material therewithin. The exterior or viewable surfaces of the sheets may be printed or embossed or screened or the like, such that cavity is positioned generally within an outline of a small dispensing tube or container.

In the illustrated embodiment, the packet 10 includes the header portion 16, such as at an upper end of the packet 10. The header portion 16 is integral with and an extension of the sealed or joined sheets or sheet portions, and may provide an advertisement or other information about the product contained within the packets or dispensers. The header portion 16 includes an opening 20 therethrough for hanging the packet 10 on a hook or post or the like at a store (or for connecting to a connector portion of another packet, as discussed below).

As shown in FIG. 1, the connector tab or portion 18 is also integral with and an extension of the sealed or joined sheets or sheet portions of the packet, and may provide an advertisement or other information about the product contained within the packets or dispensers. The connector portion 18 extends from the main body portion of the packet 10 and includes a narrowed or neck portion 18*a* and a wider retaining portion 18*b*. The wider retaining portion is flexible to allow the retaining portion 18*b* to be compressed or folded or curled so that it can be inserted through an opening or hole of a product or packet. Once the retaining portion 18*b* is received through such an opening, such that the neck portion 18*a* is at the opening, the retaining portion expands or returns towards its initial flat state and thus limits retraction of the retaining portion 18*b* from the opening.

Figure 2A:
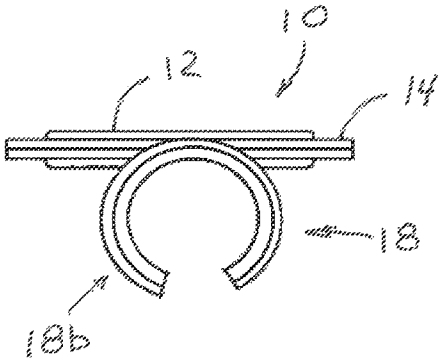
FIG. 2A is an end view of the packet of FIG. 1, shown with its connector portion coiled for insertion into the washer.
Figure 2:
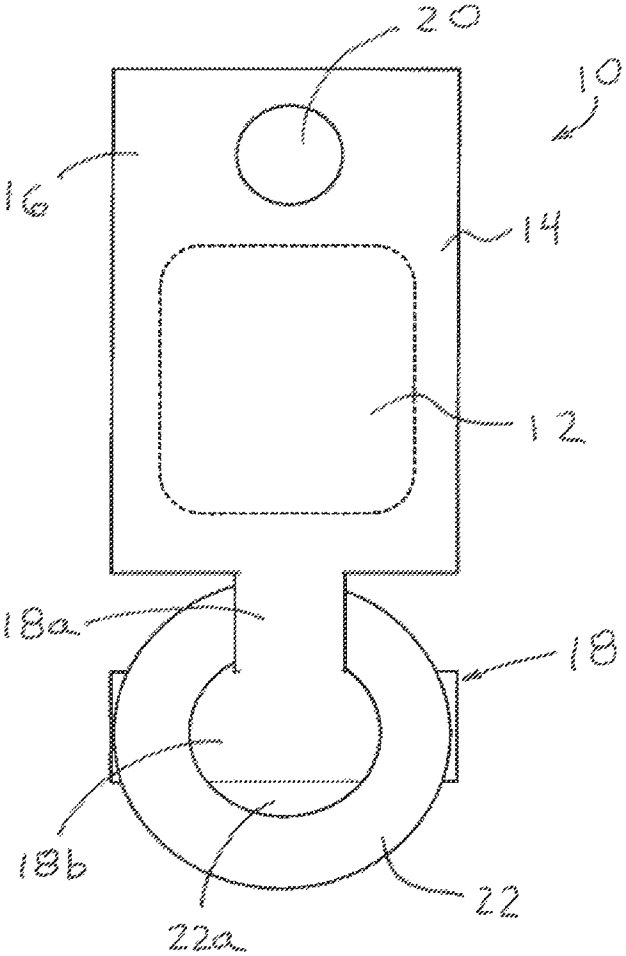
FIG. 2 is another plan view of the single use packet of FIG. 1, shown with a washer connected with the packet via the connector tab of the packet, in accordance with the present invention.

For example, and such as can be seen with reference to FIG. 2, the retaining portion 18*b* may be curled or coiled (FIG. 2A) and inserted through a product, such as a washer 22 having an aperture 22*a* therethrough. Once the retaining portion 18*b* (having a larger width or cross dimension than the neck region 18*a*) is inserted fully through the washer, such that the neck portion is within the washer aperture (and preferably having a width or cross dimension that is generally equal to or less than the diameter of the washer aperture), the retaining portion is released or uncoiled and functions to limit retraction of the connector tab 18 from the washer 22. Thus, the washer (or other product having an aperture therethrough) is retained at the packet so that the packet/product can be displayed and sold together or as a unit, yet are readily detachable (by coiling or folding the retaining portion to again allow it to pass through the aperture).

In the illustrated example, the packet may contain battery terminal grease or gel (such as a dielectric grease or gel), and the washers may comprise battery terminal washers. Thus, the packet and product are related and the packet of the present invention allows them to be displayed and sold together as a unit. A consumer may then purchase the packet and the washers together, and may find them joined together on a display rack or the like, so that the consumer is readily provided with the related or associated products without having to find and purchase them separately.

Figure 3:
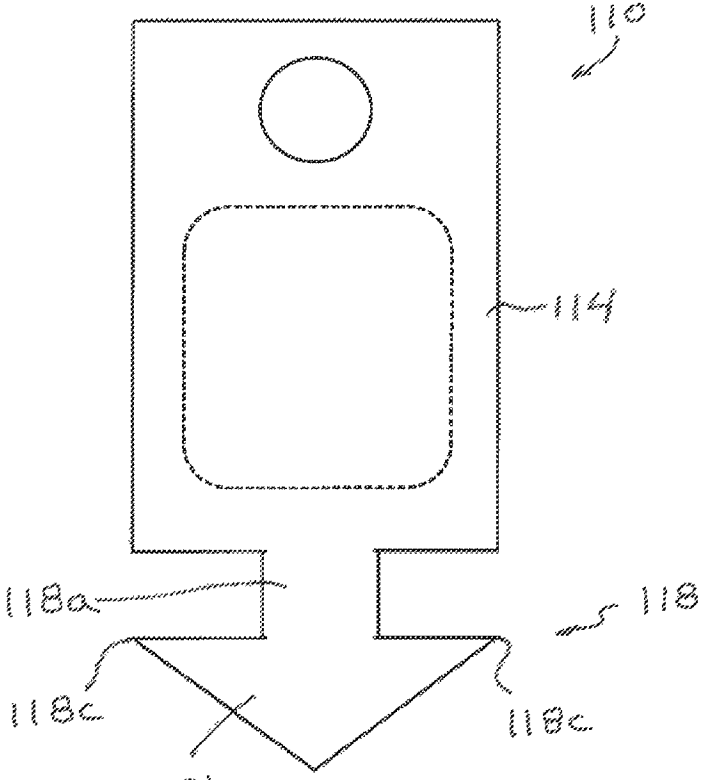
FIG. 3 is a plan view of another single use packet of flowable material in accordance with the present invention.
Figure 4:
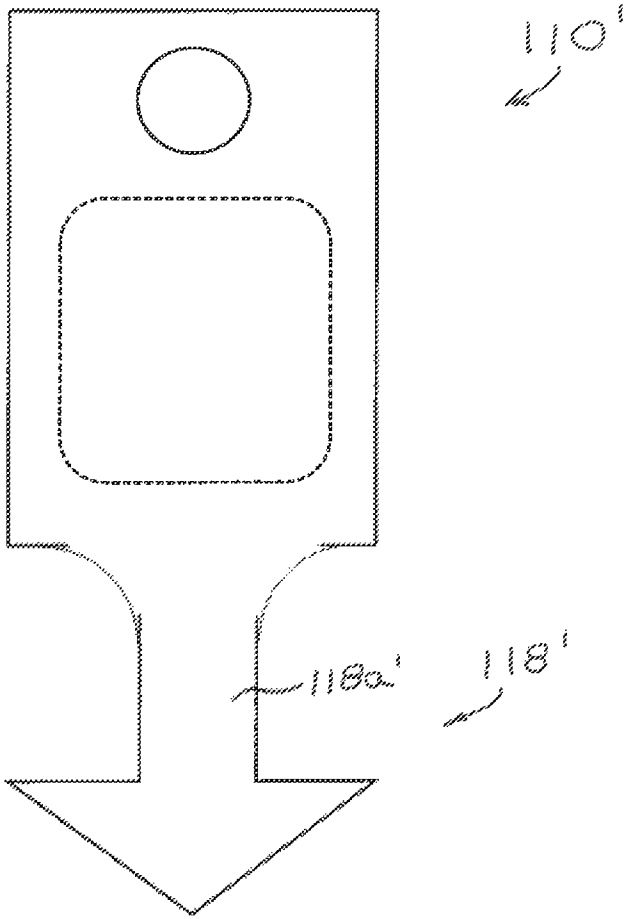
FIG. 4 is a plan view of another single use packet of flowable material in accordance with the present invention.

The connector tab is integrally formed with the packet and may be shaped or formed to any desired or suitable shape, preferably with at least a portion of the connector tab forming a neck region that is inserted through the joined product or packet and with another portion of the connector having a wider cross dimension to provide the retaining portion. For example, and with reference to FIG. 3, a packet 110 may include a connector tab 118 having a generally triangular-shaped retaining portion 118*b* at the distal end of the neck portion 118*a* extending from the sealed periphery 114 of the packet. The triangular-shaped or arrow-shaped connector may be coiled or curled in a similar manner as the connector tab 18, discussed above, for inserting into and through an aperture of a product or packet, whereby the uncoiled connector tab 118 limits removal of the product or packet from the packet 110. Due to the physical properties and dimensions of the triangular-shaped connector portion 118*b*, such a form or shape further limits removal or separation of the product/packet, because the triangular-shape tends to remain wider than the neck portion, even when the outer tips 118*c* of the triangular-shaped retaining portion 118*b* are curled inwards towards one another. Optionally, the connector portion 118' of a packet 110' (FIG. 4) may have a longer neck region 118*a*' (or optionally a shorter neck region), depending on the particular application and thickness of the product or packet that the packet is being joined with. The packets 110, 110' may otherwise be substantially similar to packet 10, discussed above, such that a detailed discussion of the packets need not be repeated herein.

Figure 6:
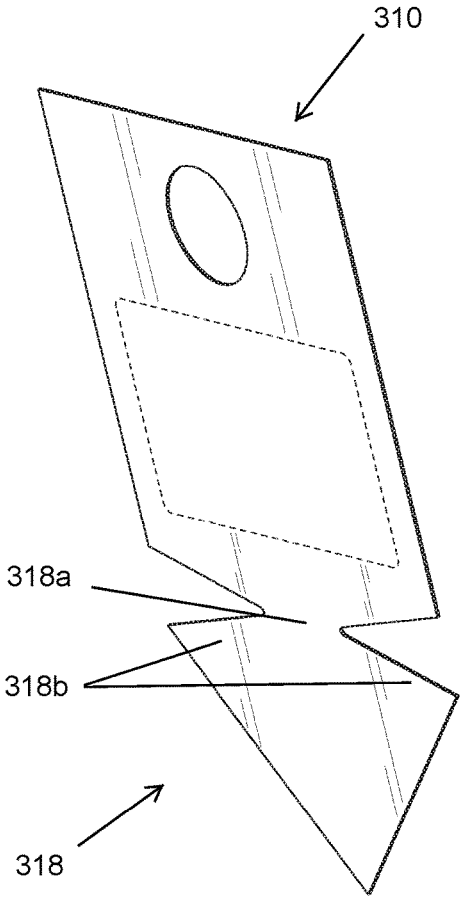
FIG. 6 is a perspective view of another single use packet of flowable material in accordance with the present invention.
Figure 7:
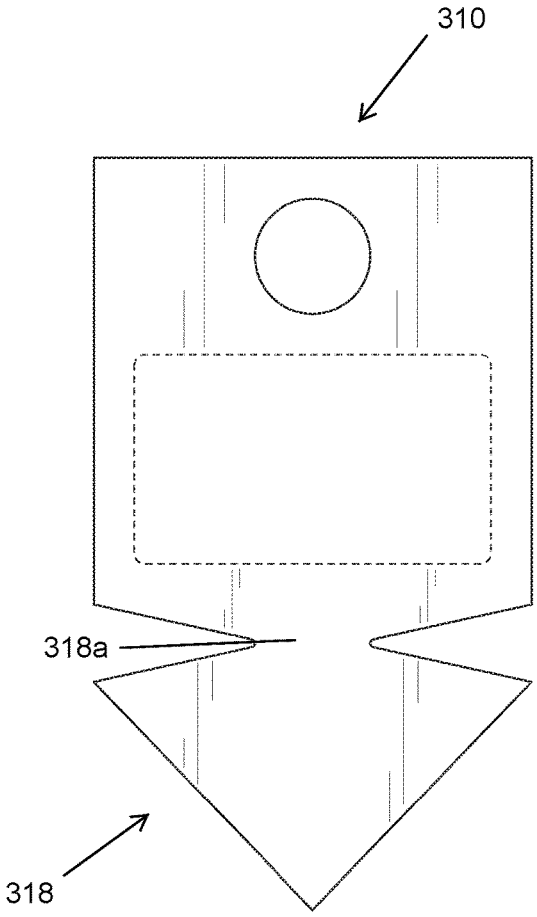
FIG. 7 is a plan view of the single use packet of FIG. 6.

Optionally, the neck region 318*a* of a connector portion 318 of a packet 310 (FIGS. 6 and 7) may be defined between opposing wedge-shaped cutouts or slots (or optionally semi-circular or curved or otherwise shaped cutouts). As such, based on the shape and orientation of the cutouts or slots, the retaining portions 318*b* of the connector portion 28 may optionally have upper edges that are generally not co-linear or aligned (FIGS. 6 and 7) or a packet 410 (FIGS. 8 and 9) may optionally have a neck region 418*a* of a connector portion 418 with retaining portions 418*b* with upper edges that are substantially co-linear or aligned to form differently shaped connector portions.

Figure 10:
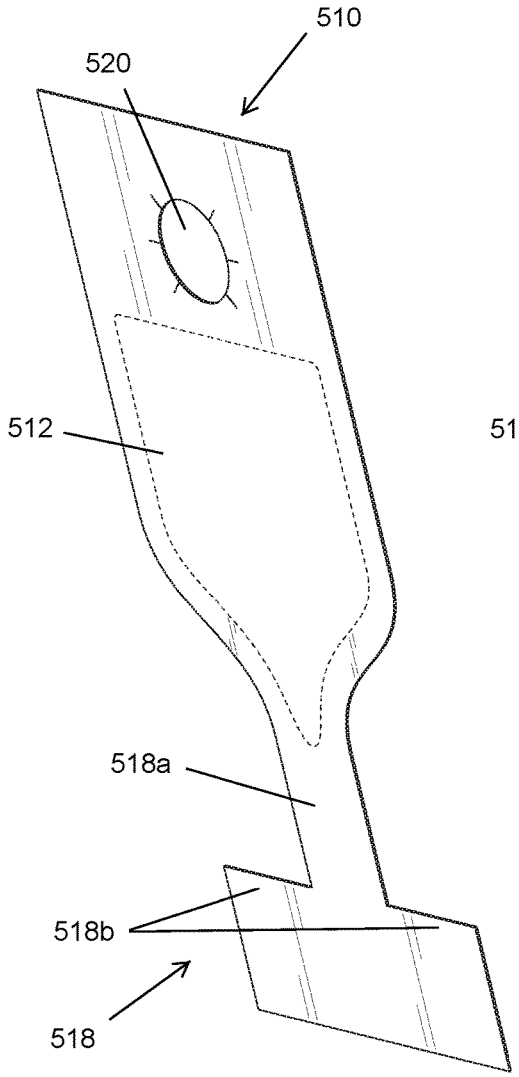
FIG. 10 is a perspective view of another single use packet of flowable material in accordance with the present invention.
Figure 11:
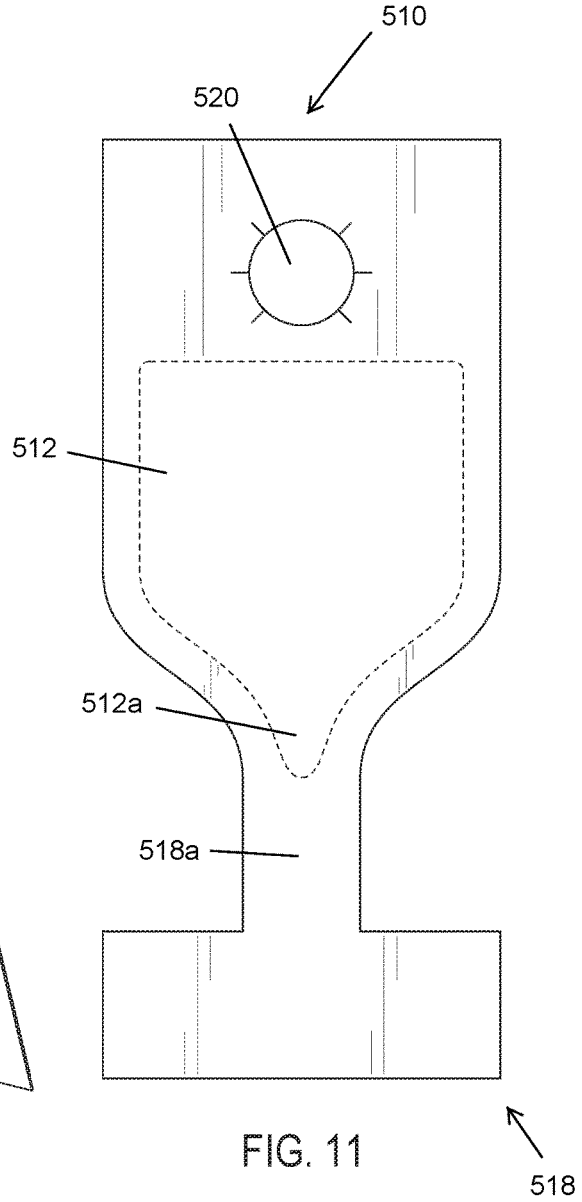
FIG. 11 is a plan view of the single use packet of FIG. 10.

Optionally, the upper portion of the neck region 518*a* of a packet 510 (FIGS. 10 and 11) may have a curved edge and may optionally follow the delineating edge of the material holding cavity 512 of the packet 510. Optionally, the material holding cavity 512 of the packet 510 may be shaped to have a tip region 512*a* (FIG. 11) that enters or approaches the neck region 518*a* of the connector portion 518, which allows the packet 510 to be severed, cut, or otherwise torn open at or near the tip region 512*a* to provide an applicator opening for dispensing the flowable material held in the material holding cavity 512. The retaining portions 518*b* of the connector portion 518 may be generally rectangular tabs (as shown in FIGS. 10 and 11) or may comprise any other suitable shape, such as those described above and the like, depending on the particular application and desired appearance and function of the packet.

Optionally, the packets of the present invention may be joined to one another to form a strip of packets, such that the strip of packets may be hung at a display rack at a store and one or more packets may be readily removed from the strip as desired. Such a display system provides reduced cost to the display, since only one display hook or rod is needed to display multiple packets, and the packets do not need to be clipped together via separate clips or hooks. For example, the connecting tab of an upper packet may be inserted through the aperture of a lower packet to retain the packets together, while the upper packet is hooked or supported on a display hook or peg or post or the like. Multiple packets may be joined or connected together in a strip in a similar manner. Then, when a consumer wants one or more of the packets, the consumer may detach the appropriate lower packet from a respective upper packet to remove the desired number of packets from the strip of packets.

Figure 5:
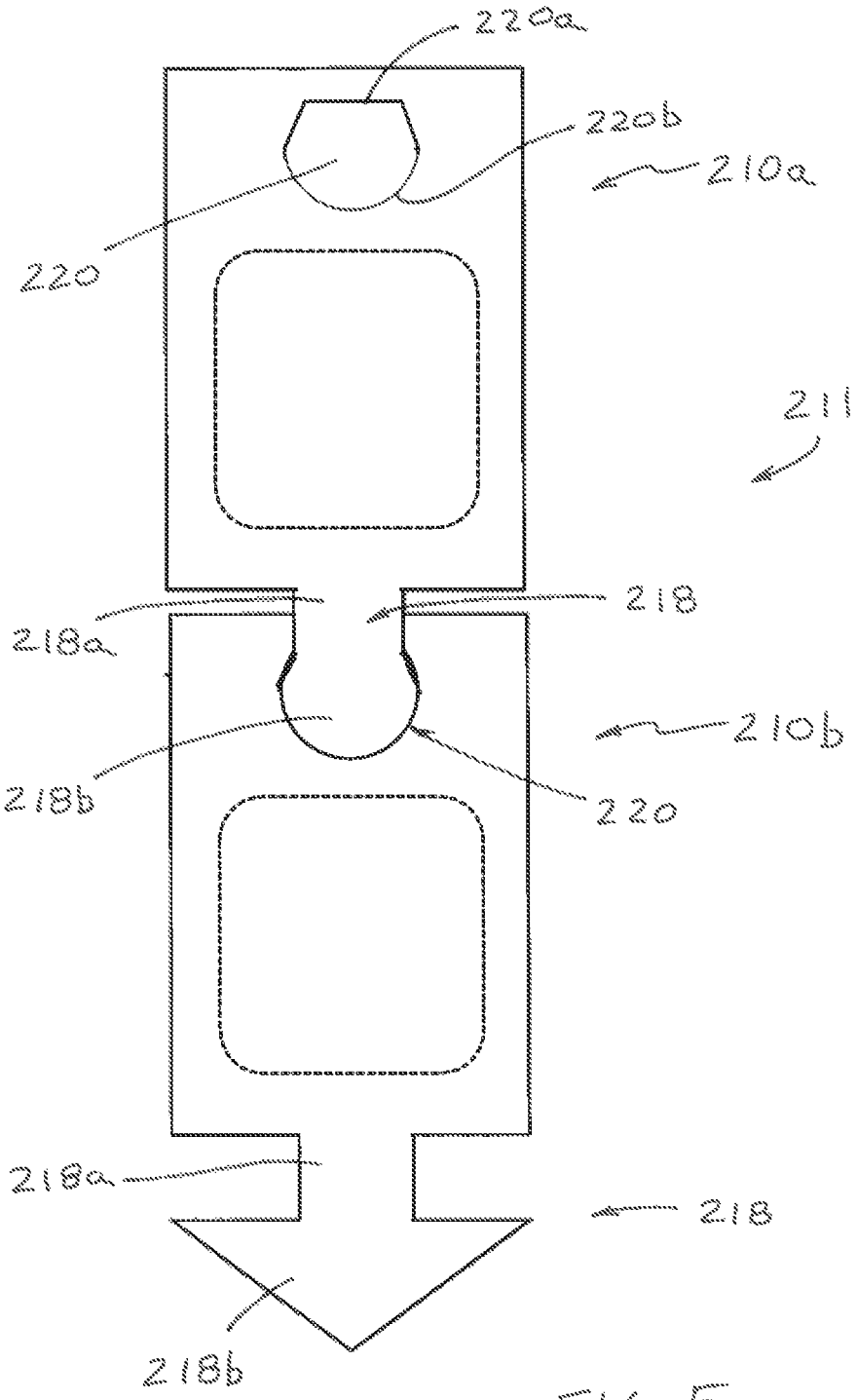
FIG. 5 is a plan view of two single use packets similar to the single use packet of FIG. 3, shown joined together via the connector tab of one packet inserting through an aperture of the other packet, in accordance with the present invention.

Optionally, for example, and with reference to FIG. 5, a strip of packets 211 may include an upper packet 210*a* and a lower packet 210*b*, with the connector tab 218 of the upper packet 210*a* being partially inserted through the aperture 220 of the lower packet 210*b* to join or connect the packets 210*a*, 210*b* together. In the illustrated embodiment, the connector tabs 218 of the packets have triangular-shaped retaining portions 218*b* at the distal ends of the neck portions 218*a*. The strip of packets 211 may contain multiple packets joined together in a similar manner and hung from a hook or peg or post at a display of a store via the hook or peg or post extending through the aperture 220 of the uppermost packet 210*a* of the strip of packets 211.

Figure 8:
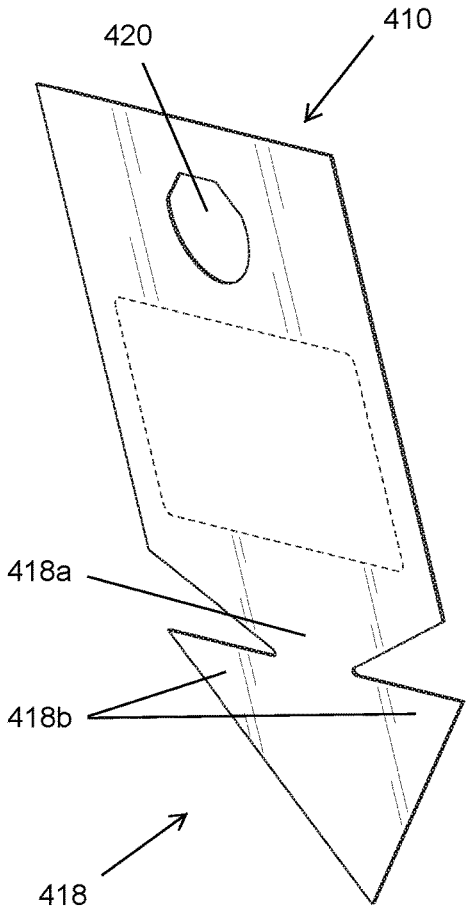
FIG. 8 is a perspective view of another single use packet of flowable material in accordance with the present invention.
Figure 9:
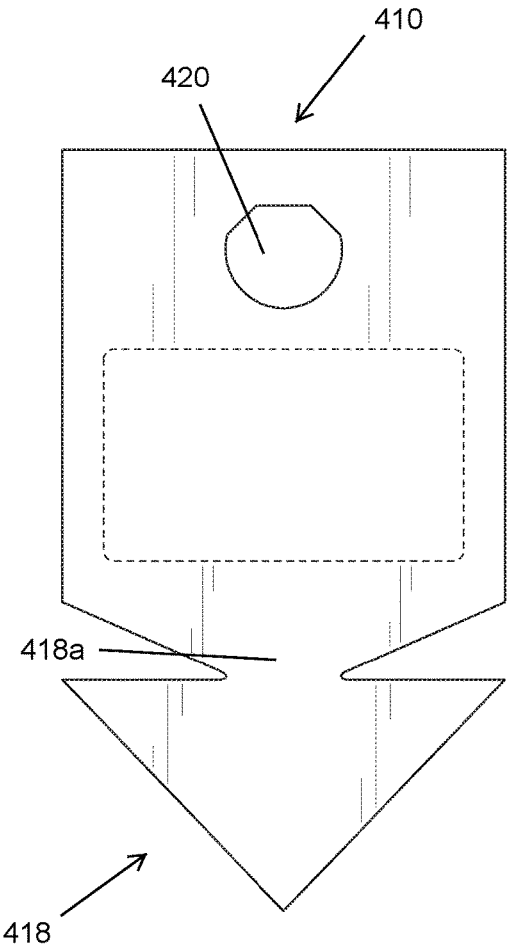
FIG. 9 is a plan view of the single use packet of FIG. 8.

Optionally, and such as shown in FIGS. 5, 8 and 9, the apertures 220, 420 of the packets may be a non-circular shape to enhance retention of the packets to one another when joined together. As shown in FIG. 5, the aperture 220 includes an upper generally horizontal edge or portion 220*a* that has a similar cross dimension as the width dimension of the neck portion 218*a*. The aperture may include a lower generally circular portion 220*b* that is wider than the upper portion 220*a* to ease insertion of the retaining portion 218*b* of the connector tab 218 into the aperture 220.

Optionally, and such as shown in FIGS. 10 and 11, the aperture 520 of the packet 510 may include radially extending slits spaced around the aperture 520 to allow the aperture to flex and expand upon insertion of the connector portion 518 of another packet, thereby reducing the potential bending or curling of the retaining portion 518*b* that would otherwise be necessary to allow the retaining portion to be inserted through the aperture 520.

As shown in FIG. 5, when the retaining portion of the connector tab 218 of the upper packet 210*a* is inserted through the aperture 220 of the lower packet 210*b*, the neck portion 218*a* is along the upper portion 220*a* of the aperture 220 and along the front of the packet 210*b*, with the retaining portion of the connector tab 218 being at the back or opposite side of the lower packet 210*b*. The edges or corners of the non-circular aperture 220 assist in retaining the connector tab through the aperture to hold the adjacent or joined packets together. During use, if easier removal of packets (such as if the joined packets all contain the same material) is desired, then inserting the arrow-shaped connector from the front to the rear of the packets (as shown in FIG. 5) is preferred. Optionally, if it is desired to keep the packets together (such as when two packets are sold as a kit of two related or associated products), then it may be preferable to insert the arrow-shaped connector tab from the rear of the packet to the front of the packet. This is due to the geometries and dimensions of the connector and the aperture at the header portion and how the user or consumer tends to fold or curl the connector tabs when joining and separating the packets (depending on whether the user is pushing the connector tab through the aperture or pulling the connector tab from the aperture). Optionally, a strip of packets could contain multiple kits joined together, with the upper and lower packets of each kit joined with the arrow-shaped connector inserted from back to front, and with the kits joined together with the arrow-shaped connector of a lower packet of an upper kit inserting from front to back into an aperture of an upper packet of a lower kit.

Therefore, the present invention provides a single use packet of flowable material that has a connector tab integrally formed as part of the sealed periphery of the packet. The connector tab is formed to fit (when curled or collapsed) through an aperture of a product or other packet, whereby (when uncurled or expanded) the connector tab retains the packets/products together, while also allowing for relatively easy removal or separation of the packets/products.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A display system comprising:

a plurality of packets configured to be disposed at a display structure, wherein each of said packets comprises a body portion having a cavity containing flowable material and a sealed perimeter portion that circumscribes said cavity;

wherein each of said packets comprises a header portion at one end of said body portion and a connector tab at an opposite end of said body portion, and wherein said header portion has an aperture therethrough;

wherein said connector tab of each of said packets comprises a neck portion and a retaining portion, and wherein said neck portion is disposed between said retaining portion and said body portion of the respective packet, and wherein said retaining portion has a wider cross dimension than said neck portion, and wherein said retaining portion has a wider cross dimension than said aperture;

wherein, with said plurality of packets disposed at the display structure, said connector tab of a first packet of said plurality of packets is received through said aperture of said header portion of a second packet of said plurality of packets such that said neck portion of the first packet is disposed at said aperture of said header portion of the second packet;

wherein, with said connector tab of the first packet received through said aperture of said header portion of the second packet, said retaining portion of the first packet is disposed at a side of said header portion of the second packet that is opposite from a side of said header portion of the second packet where said body portion of the first packet is disposed; and wherein, with said connector tab of the first packet received through said aperture of said header portion of the second packet, said retaining portion of the first packet limits retraction of said connector tab of the first packet from said header portion of the second packet.

2. The display system of claim 1, wherein said retaining portion of the first packet is collapsible to a collapsible state so as to be received through said aperture of said header portion of the second packet, and wherein said retaining portion of the first packet is expandable to an expanded state when disposed at the side of said header portion of the second packet that is opposite from the side of said header portion where said body portion of the first packet is disposed.

3. The display system of claim 2, wherein said retaining portion of the first packet, when expanded to its expanded state, limits retraction of said connector tab of the first packet from said aperture of said header portion of the second packet to join the first and second packets together.

4. The display system of claim 1, wherein said packets each comprise two foil sheets that are sealed together about said perimeter portion and are not sealed together at said cavity.

5. The display system of claim 4, wherein said packets each comprise a single use packet that is tearable to open said cavity for dispensing the flowable material from said cavity.

6. The display system of claim 1, wherein said retaining portion of each of said packets comprises a rectangular shape.

7. The display system of claim 1, wherein said retaining portion of each of said packets comprises a triangular shape, with a wider part of said triangular shape being at said neck portion and with said retaining portion narrowing away from said neck portion.

8. The display system of claim 1, wherein said cavities of the first and second packets contain the same flowable material.

9. The display system of claim 1, wherein said cavities of the first and second packets contain different flowable materials.

10. The display system of claim 1, wherein the first and second packets, when joined together via said connector tab of the first packet received in said aperture of said header portion of the second packet, are part of a strip of multiple packets.

11. The display system of claim 1, wherein said aperture comprises a circular aperture.

12. The display system of claim 1, wherein said aperture comprises a non-circular aperture having a straight upper portion that has a width dimension that is similar to a width dimension of said neck portion.

13. The display system of claim 1, wherein said header portion of each of said packets comprises radial slots disposed at said aperture to facilitate expansion of said aperture for receiving said retaining portion of said connector portion of another packet therethrough.

14. The display system of claim 1, wherein said header portion comprises a sealed together upper extension of the respective packet and said connector tab comprises a sealed together lower extension of the respective packet.

15. The display system of claim 1, wherein said retaining portion of the second packet, when said packets are disposed at the display structure, is received through an aperture of a product and limits retraction from the aperture of the product to join said packets with the product.

16. The display system of claim 15, wherein the flowable material comprises battery terminal grease and wherein the product comprises at least one battery terminal washer.

17. A display system comprising:

a first packet and a second packet configured to be disposed at a display structure;

wherein said first packet comprises a first body portion having a first cavity containing flowable material and a first sealed perimeter portion that circumscribes said first cavity;

wherein said first packet comprises a first header portion at one end of said first body portion and a first connector tab at an opposite end of said first body portion, and wherein said first header portion has a first aperture therethrough;

wherein said first connector tab of said first packet comprises a first neck portion and a first retaining portion, and wherein said first neck portion is disposed between said first retaining portion and said first body portion, and wherein said first retaining portion has a wider cross dimension than said first neck portion;

wherein said second packet comprises a second body portion having a second cavity containing flowable material and a second sealed perimeter portion that circumscribes said second cavity;

wherein said second packet comprises a second header portion at one end of said second body portion and a second connector tab at an opposite end of said second body portion, and wherein said second header portion has a second aperture therethrough;

wherein said second connector tab of said second packet comprises a second neck portion and a second retaining portion, and wherein said second neck portion is disposed between said second retaining portion and said second body portion, and wherein said second retaining portion has a wider cross dimension than said second neck portion;

wherein said first retaining portion is collapsible to a collapsible state so as to be received through said second aperture of said second header portion;

wherein, with said first and second packets disposed at the display structure, and with said first retaining portion in its collapsed state, said first connector tab is received through said second aperture of said second header portion such that said first neck portion is disposed at said second aperture of said second header portion;

wherein, with said first connector tab received through said second aperture of said second header portion, said first retaining portion is disposed at a side of said second header portion that is opposite from a side of said second header portion where said first body portion is disposed;

wherein said first retaining portion is expandable to an expanded state when disposed at the side of said second header portion that is opposite from the side of said second header portion where said first body portion is disposed; and wherein, with said first connector tab received through said second aperture of said second header portion, and with said first retaining portion in its expanded state, said first retaining portion limits retraction of said first connector tab from said second header portion so as to join said first packet to said second packet.

18. The display system of claim 17, wherein said first retaining portion comprises a rectangular shape.

19. The display system of claim 17, wherein said first retaining portion comprises a triangular shape, with a wider part of said triangular shape being at said first neck portion and with said first retaining portion narrowing away from said first neck portion.

20. The display system of claim 17, wherein said second aperture comprises a non-circular aperture having a straight upper portion that has a width dimension that is similar to a width dimension of said first neck portion.

21. The display system of claim 17, wherein said second header portion comprises radial slots disposed at said second aperture to facilitate expansion of said second aperture for receiving said first retaining portion of said first connector tab therethrough.

22. The display system of claim 17, wherein said second retaining portion of said second packet, when said first and second packets are disposed at the display structure, is received through an aperture of a product and limits retraction from the aperture of the product to join said first and second packets with the product.

* * * * *